United States Patent [19]

Nelson

[11] Patent Number: 5,054,411

[45] Date of Patent: Oct. 8, 1991

[54] HIGH PERFORMANCE SAILING CRAFT

[76] Inventor: Victor A. Nelson, 14931 Cobre Valley Dr., Houston, Tex. 77062

[21] Appl. No.: 493,486

[22] Filed: Mar. 14, 1990

[51] Int. Cl.[5] ..... B63B 1/00

[52] U.S. Cl. ..... 114/61; 114/39.1; 114/91

[58] Field of Search ..... 114/39.1, 61, 90, 91, 114/89, 123, 272, 284, 292

[56] References Cited

U.S. PATENT DOCUMENTS 4,638,755 1/1987 Butka ..... 114/91

4,706,590 11/1987 Hoyt ..... 114/91

*Primary Examiner*—Ed Swinehart

*Attorney, Agent, or Firm*—Browning, Bushman, Anderson & Brookhart

[57] ABSTRACT

A pair of outrigger hulls are located on the ends of a wing, to which is movably attached a central hull which can be moved back and forth with respect to the outrigger hulls. A pivotable mast positioned on the central hull allows the central hull to be positioned near the leeward outrigger hull while leaning the mast towards the windward outrigger hull, thereby providing a lift to the craft and a reduction in displacement. Rotary wheels at each end of the wing allow crewmen stationed there to control the position of the central hull along the length of the wing and to control the slack and tautness of a pair of sail lines. A differential apparatus enables crewman to control the rudder from anywhere along the length of the wing independently of the central hull location along the length of the wing.

9 Claims, 10 Drawing Sheets

HIGH PERFORMANCE SAILING CRAFT

BACKGROUND OF THE INVENTION

1. Field of the Invention

This invention relates, generally, to a new and improved, high performance sailing craft. More particuarly, the invention relates to a high performance sailing craft having a pivotable mast and also having a main central hull movable transversely between a pair of outrigger hulls.

2. Description of the Background

In the art of sailing craft, it is well recognized that sailboats tend to heel in the leeward direction from the wind forces. In a strong wind, such heeling significantly reduces the effective sail area and thus the speed, and also results in the hull contacting the water at an angle which increases its resistance to forward movement through the water, thus further limiting the speed of the craft. In addition, severe heeling can result in a capsizing of the boat, or of taking water over the leeward side. Those in the art have proposed various trimaran sailing craft, generally intended to limit heeling, which typically comprise a relatively large central hull and a pair or smaller stabilizing outrigger hulls mounted at the sides of the central hull. In one such prior art sailboat, as shown in U.S. Pat. No. 1,678,023 to J.D. Stites, the outrigger hulls are mounted to the central hull section by means of a slide bar, whereby the outrigger hulls may be moved laterally across the central hull.

As yet another example of a trimaran sailboat, in U.S. Pat. No. 4,286,534 to S.N. Sanner, there is shown a central hull and a boom assembly mounted laterally across the central hull having an outrigger hull at each end thereof.

In U.S. Pat. No. 4,287,845 to S.N. Sanner, there is shown a central deck assembly mounted for lateral movement between two outrigger hulls.

As yet another example of the prior art, in U.S. Pat. No. 4,286,533 to S.N. Sanner, there is shown a similar central hull located between a pair of outrigger hulls.

It is also known in the prior art, for example, in U.S. Pat. No. 4,785,754 to M. Barberis, to provide a mast on a catamaran which is pivotally mounted on a transverse beam connecting two hulls, but which pivots only in response to the wind exceeding a predetermined value, thus allowing the mast and sail to fall, avoiding the capsizing of the craft.

Each of the above-mentioned references dealing with a central hull movable between a pair of outrigger hulls has a common shortcoming in that the crew members are required to stay in the central hull to effect the movement of the central hull between the two outrigger hulls, and to operate the rudder. Moreover, none of the prior art references discussed above having a central hull and a pair of outrigger hulls utilizes a pivotable mast on the central hull which allows the mast to be pivoted, for example, in the windward direction.

It is therefore the primary object of the present invention to provide a new and improved sailing craft which enables the crew members to position themselves outside the central hull while yet maintaining the ability to control the positioning of the central hull between the outrigger hulls.

It is also an object of the present invention to provide a new and improved sailing craft which allows the rudder of the craft to be controlled by crew members stationed outside the confines of the central hull, independently of the location of the central hull and rudder with respect to the location of the outrigger hulls.

It is yet another object of the present invention to provide a new and improved sailing craft having a central hull positioned near the leeward outrigger hull and having a pivotable mast mounted on the central hull which can be pivoted in the windward direction to provide vastly improved sailing characteristics.

SUMMARY OF THE INVENTION

The objects of the invention are accomplished, generally, by the provision of a sailing craft in which a pivotable mast is first moved towards a leeward outrigger hull and then, with sail attached, is leaned towards a windward outrigger hull.

As an additional feature of the invention, a method is provided which utilizes the step of leaning a pivotable mast into the wind to achieve a lifting of the craft and the reduction of displacement.

As another feature of the invention, means are provided at at least one end of a wing for controlling the position of a central hull between the ends of the wing.

As still another feature of the invention, a rudder control is provided which enables crewmen stationed along the length of the wing to control the rudder independently of the location of a central hull containing the rudder along the length of the wing.

BRIEF DESCRIPTION OF THE DRAWINGS

The various objects, features and advantages of the present invention will be more fully appreciated and understood by reference to the accompanying drawings, in which.

DETAILED DESCRIPTION OF THE DRAWINGS

Figure 1:
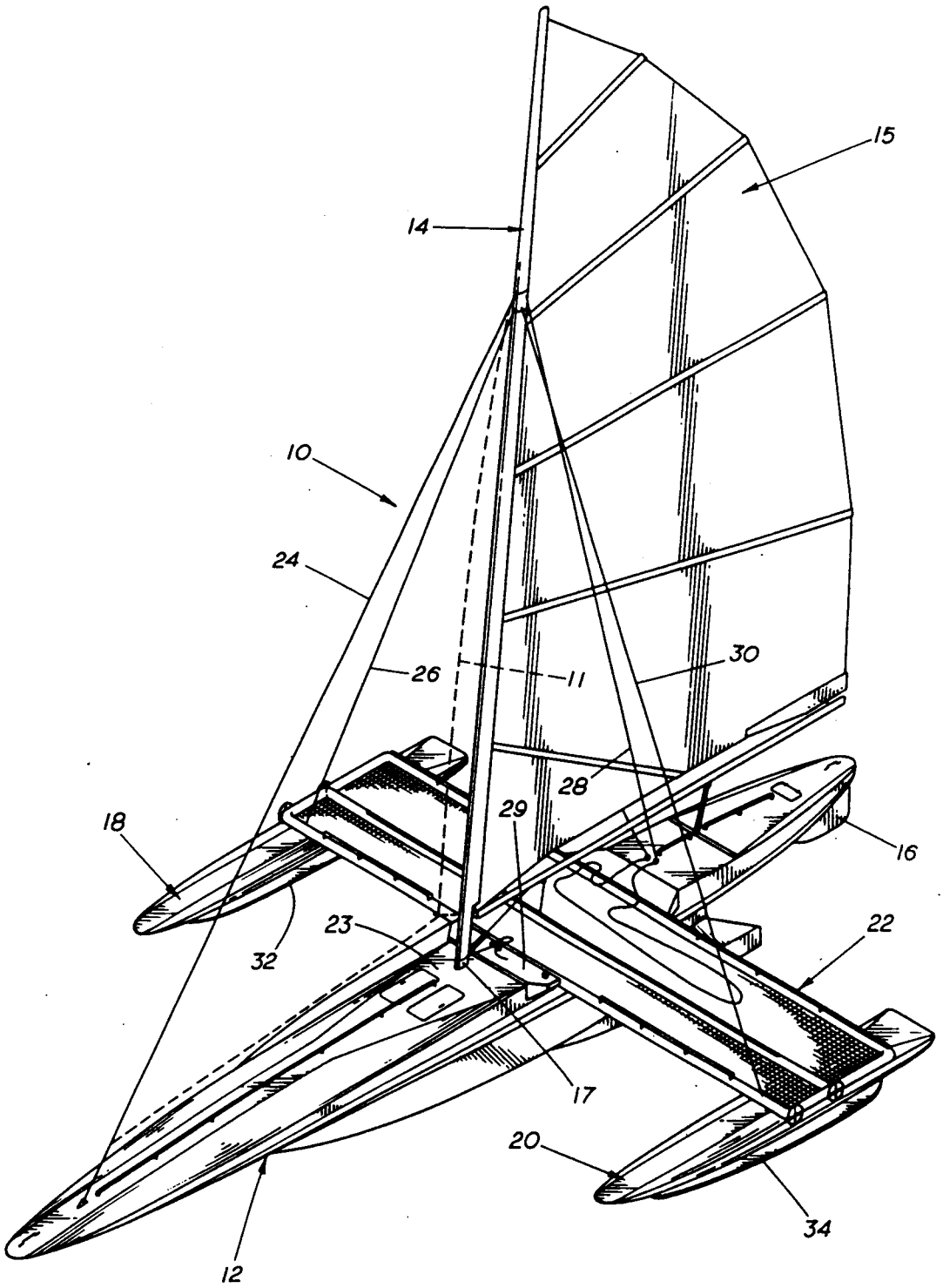
FIG. 1 is an elevated, pictorial view of a sailing craft according to the present invention.
Figure 2:
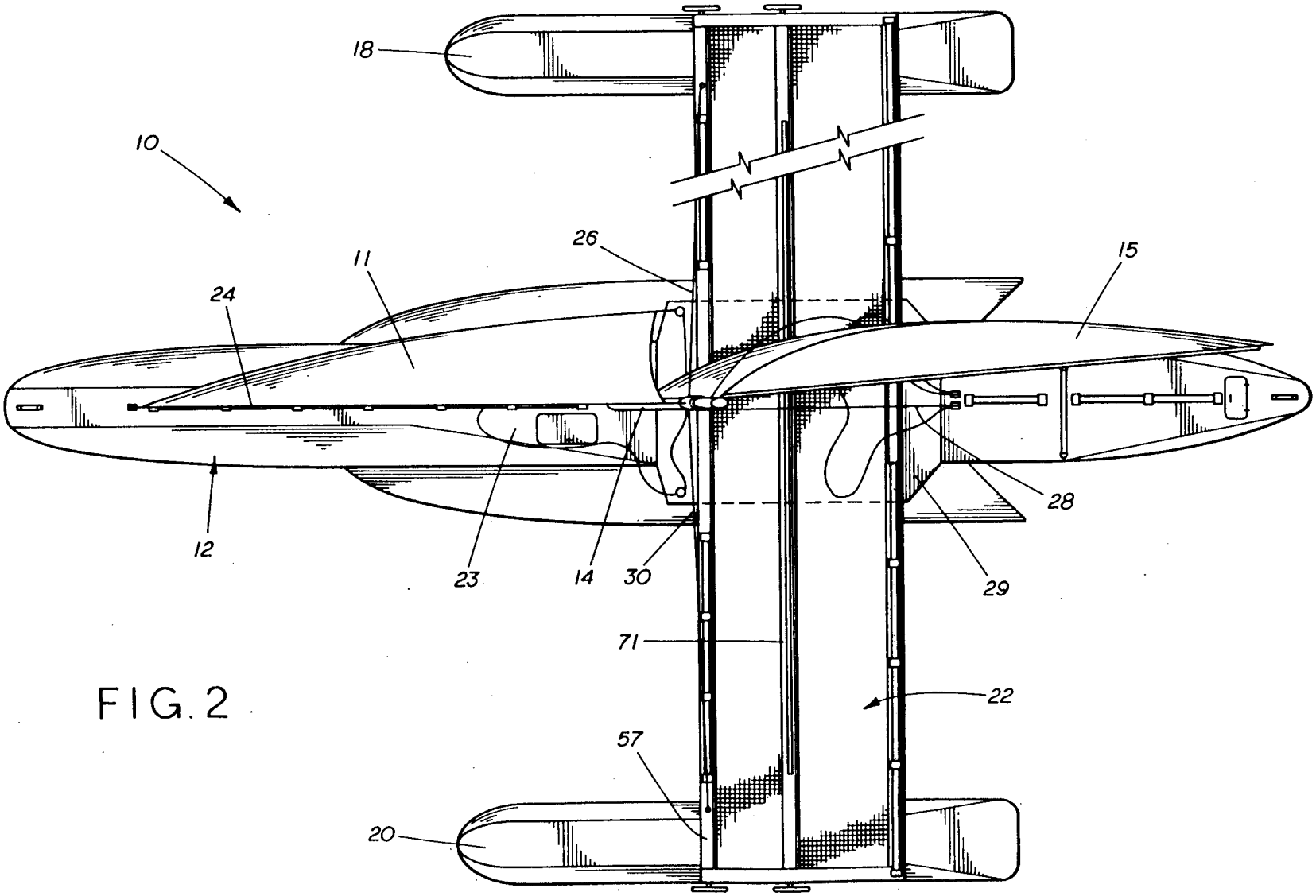
FIG. 2 is a pictorial, top plan view of the sailing craft in accordance with the present invention.
Figure 3:
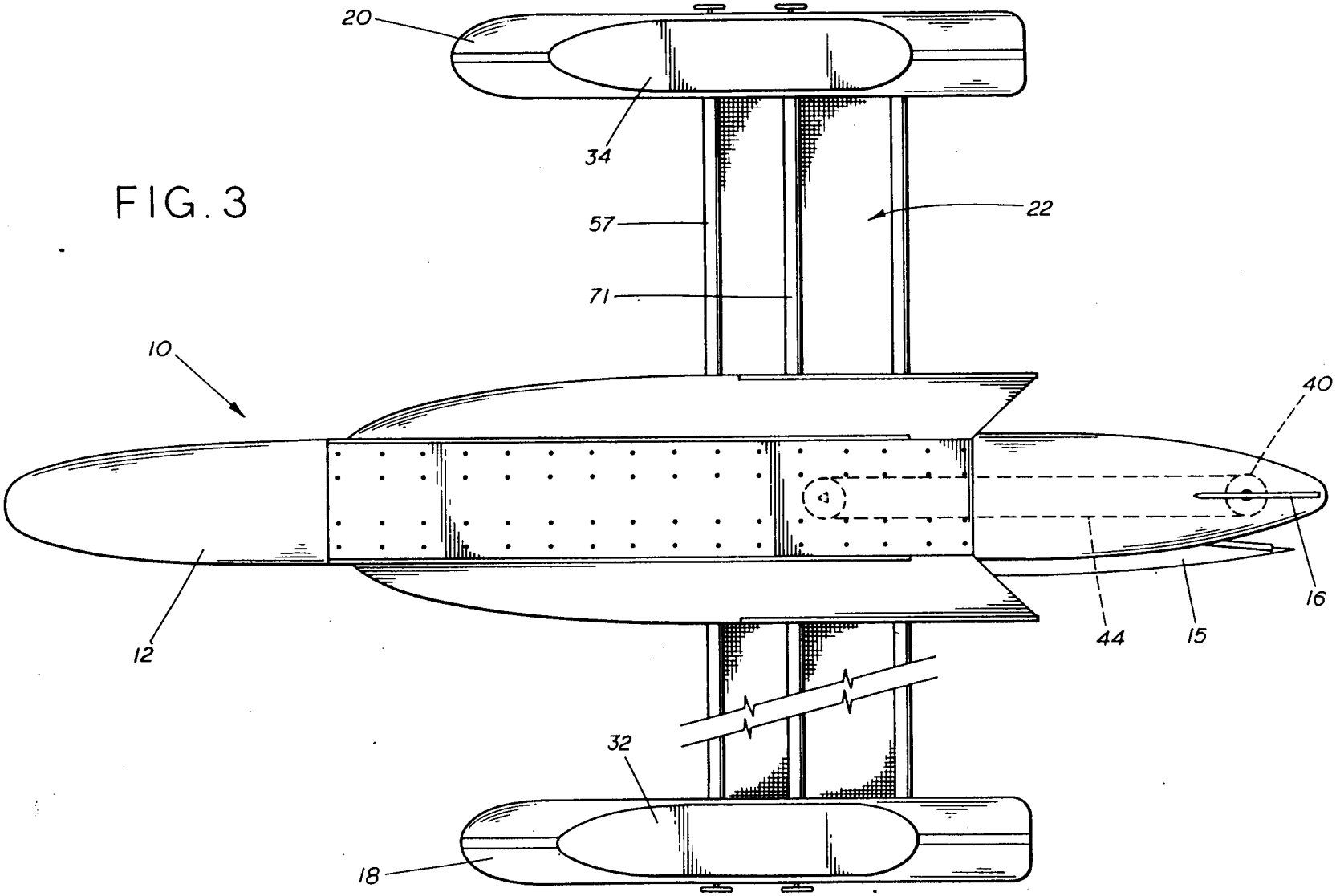
FIG. 3 is a pictorial, bottom plan view of the sailing craft in accordance with the present invention.
Figure 4:
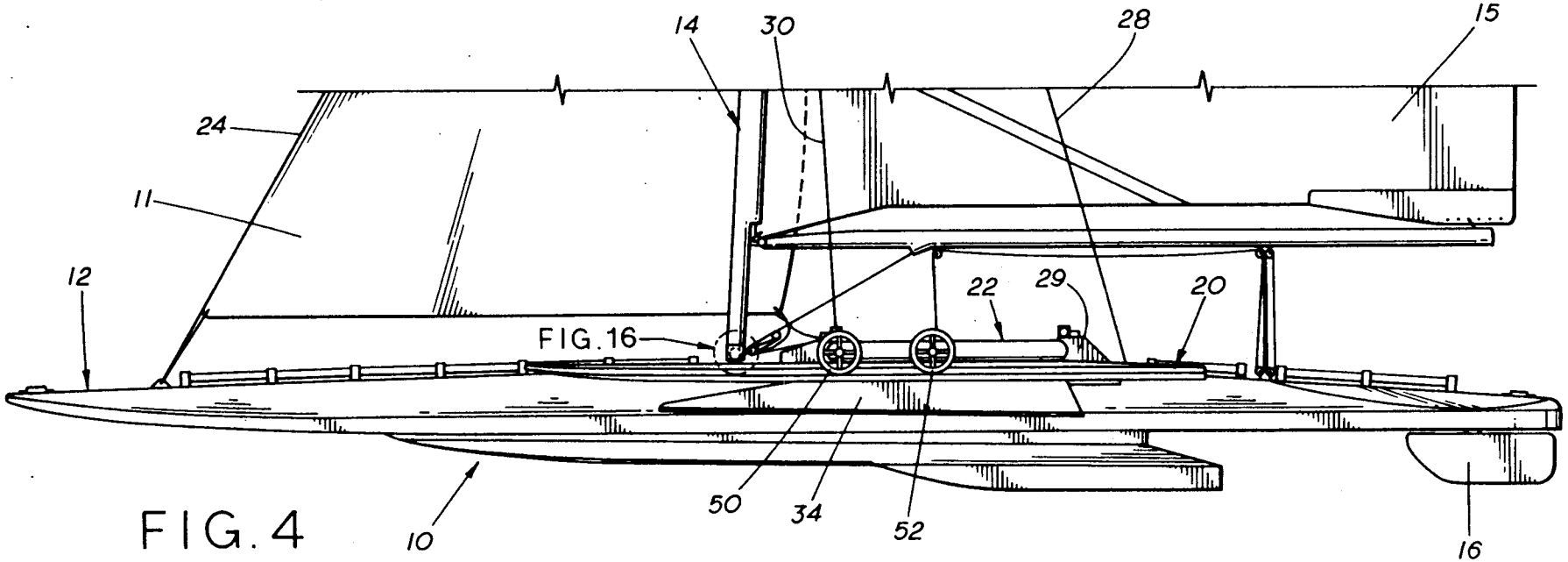
FIG. 4 is an elevated side view of the sailing craft in accordance with the present invention.
Figure 5:
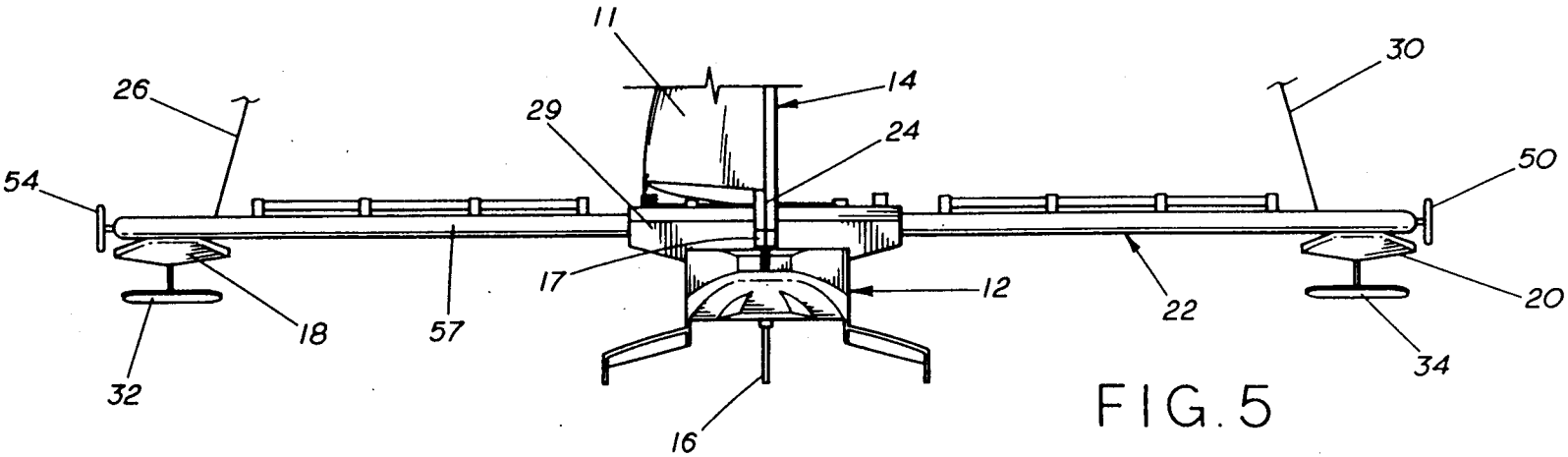
FIG. 5 is an elevated end view of the sailing craft in accordance with the present invention.

Referring now to FIG.'S 1—3, there is illustrated in pictorial views the sailing craft 10 according to the present invention. The sailing craft 10 includes a central hull 12 having a pivotable mast 14 and a rudder 16. A pair of outrigger hulls 18 and 20 at the extreme ends of the wing 22 are arranged such that the central hull 12, by means as disclosed hereinafter, can be positioned at various locations between the outrigger hulls 18 and 20. Also as will be explained in more detail hereinafter, the mast 14 having a sail 15 can be pivoted in the direction of either outrigger hull 18 or outrigger hull 20 in accordance with the present invention. The mast 14 is supported and controlled by the lines 24, 26, 28 and 30. A jib sail 11 is shown in dotted line to avoid obscurring other details of FIG. 1.

Figure 10:
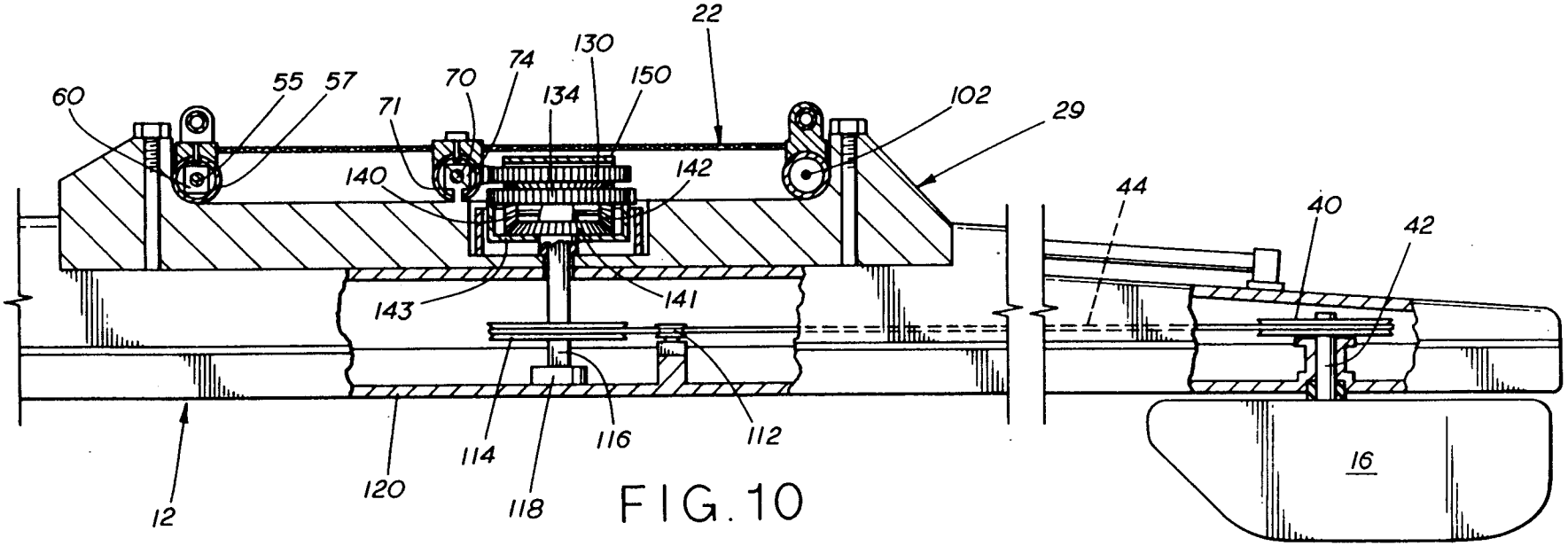
FIG. 10 is an elevated view, partly in cross-section, of the differential mechanism used to control the rudder of the sailing craft in accordance with the present invention.

Referring now to FIG.'S 4 and 5, the outboard hulls 18 and 20 are illustrated as having hydrofoils 32 and 34 attached to their undersides, respectively. The central hull 12 is a single, long, flat, low displacement, tunnelled planing hull which is preferrably approximately 30 feet in length, 3 feet in width and 1 foot in height over much of its length which will allow its shallow draft (not counting the keel) of only a couple of inches when not planning and which is designed to plane earlier and zero taper of the stearn will help it to plane flat. Approximately about two-thirds of the way back of the hull is the wing platform 29 that attaches to the central hull 12 with bolts topped by wing nuts. The wing 22 is movable within the platform 29, as illustrated in FIG. 10, thus causing the central hull to be movable between the outrigger hulls 18 and 20.

Figure 6:
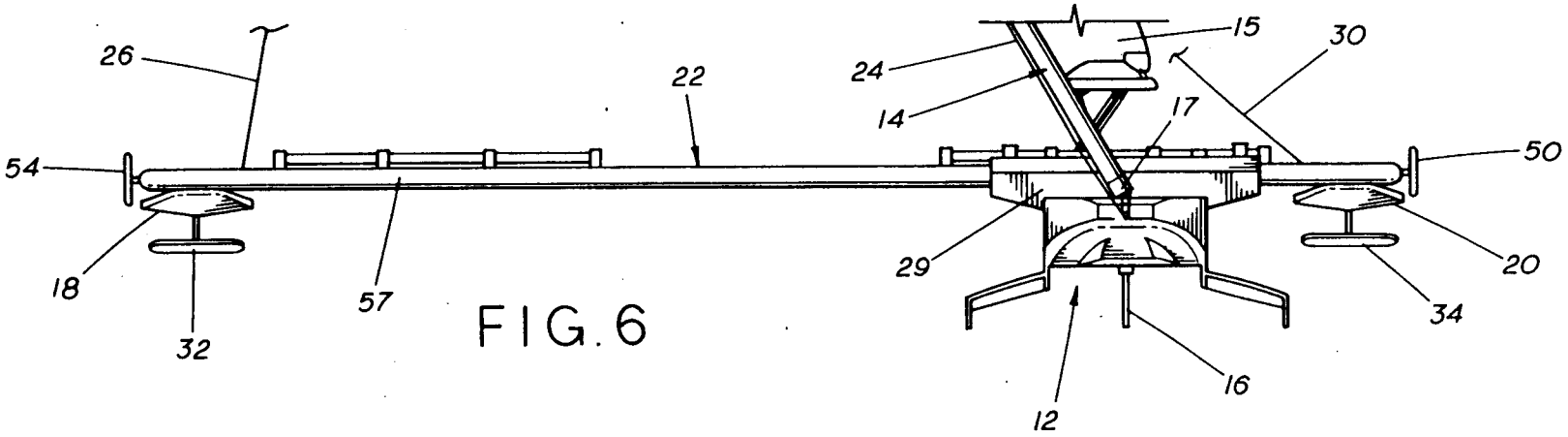
FIG. 6 is another elevated end view of the sailing craft in accordance with the present invention wherein the central hull has been moved near one of the outrigger hulls and the mast has been pivoted in the generaly direction of the other outrigger hull.

Referring now to FIG. 6, in a manner which will be described hereinafter, the main hull 12 is illustrated as having been moved to a position near the outrigger hull 20, away from the outrigger 18, and in which the mast 14 has been pivoted in a direction towards the outrigger hull 18.

Figure 16:
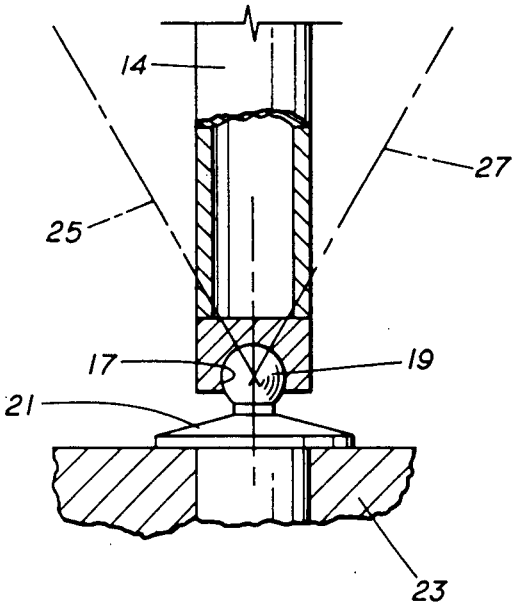
FIG. 16 is an elevated view, partly in cross-section, of the pivoting mechanism used to pivot the mast in accordance with the present invention.

Referring now to FIG. 16, the lower end of the mast 14 is shown in greater detail. The extreme lower end of the mast 14 has a socket 17 in which a ball 19 resides and about which the mast 14 can pivot. The ball 19 is mounted on a pedestal 21 mounted on the surface 23 of the central hull 12. Although not illustrated, those skilled in the art will recognize that various well known gripping mechanisms can be used to ensure that the mast 14 is secured to the ball 19 to prevent the socket 17 from disengaging the ball 19 until so desired.

Referring now to FIG.'S 7-9, the wing 22 is illustrated in a top plan view, partly in cross-section, to illustrate the mechanism for moving the central hull 12 with respect to the outrigger hulls 19 and 20 and also the mechanism for controlling the rudder.

The rotation of the rudder 16 (not illustrated in FIG. 7) is controlled by the turning of the pulley 40 which drives a shaft 42 connected to the rudder 16, best illustrated in FIG. 10. The pulley 40 is driven by belt 44 connected to the differential mechanism illustrated in FIG.'S 10 and 11.

Referring further to FIG.'S 7-9, there is illustrated a pair of control wheels 50 and 52 located on the port side of the wing and a second pair of control wheels 54 and 56 on the starboard side of the wing 22. The details and the operation of the wheels 50 and 54 can best be understood by referring to FIG. 12, in which either of the wheels 50 and 54 turns a threaded shaft 55. The shaft 55 threadedly engages a box 60. The box 60 is connected to lines 30 and 26 (illustrated in FIG. 1). The lines 26 and 30 pass over pulleys 62 and 64, each of which is connected to the tube 57, in dependently of the shaft 55. The tube 57 is fixedly attached to the wing 22.

Figure 12:
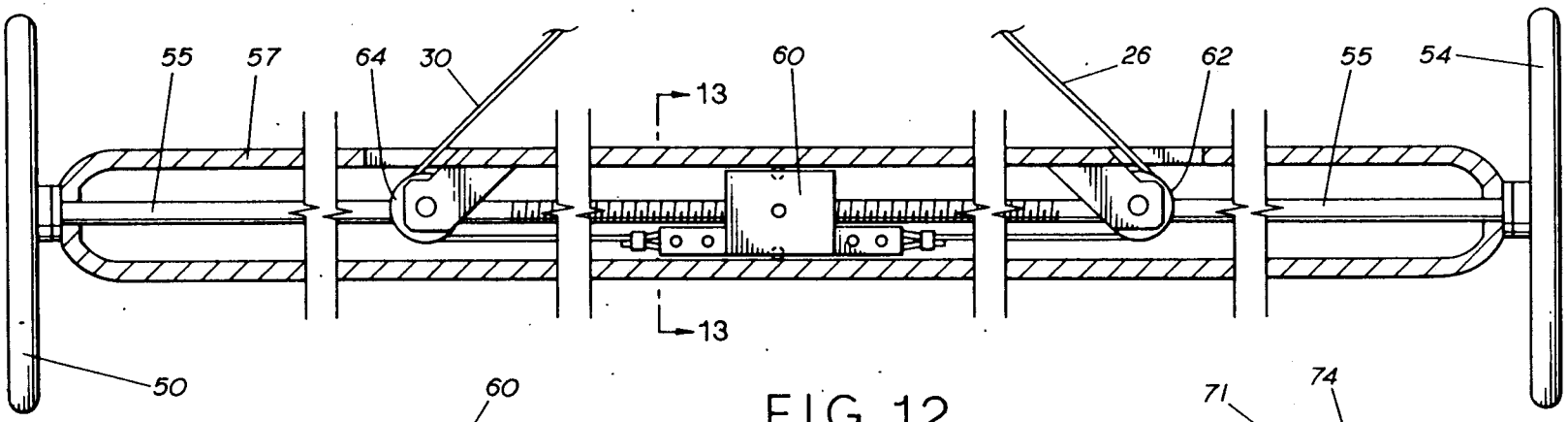
FIG. 12 is an elevated view, partly in cross-section, of the control mechanism used by the crew members to control a pair of the lines used in accordance with the present invention.

In the operation of the apparatus illustrated in FIG. 12, it should be appreciated that by turning either of the rotary handles 50 and 54, the lines 26 and 30 can be made either more taut or more slack as desired. As one line gets more taut, the other becomes more slack, and vice versa. For example, if handle 54 is turned in a direction to cause box 60 to move toward handle 54, this causes line 26 to go more slack and line 30 to go more taut. This enables, among other things, the pivoting of the mast 14. By slacking line 26, for example, and causing line 30 to go taut, the mast 14 can be leaned in the direction of rotary wheel 50, and vice versa.

Figures 7, 8, 9:
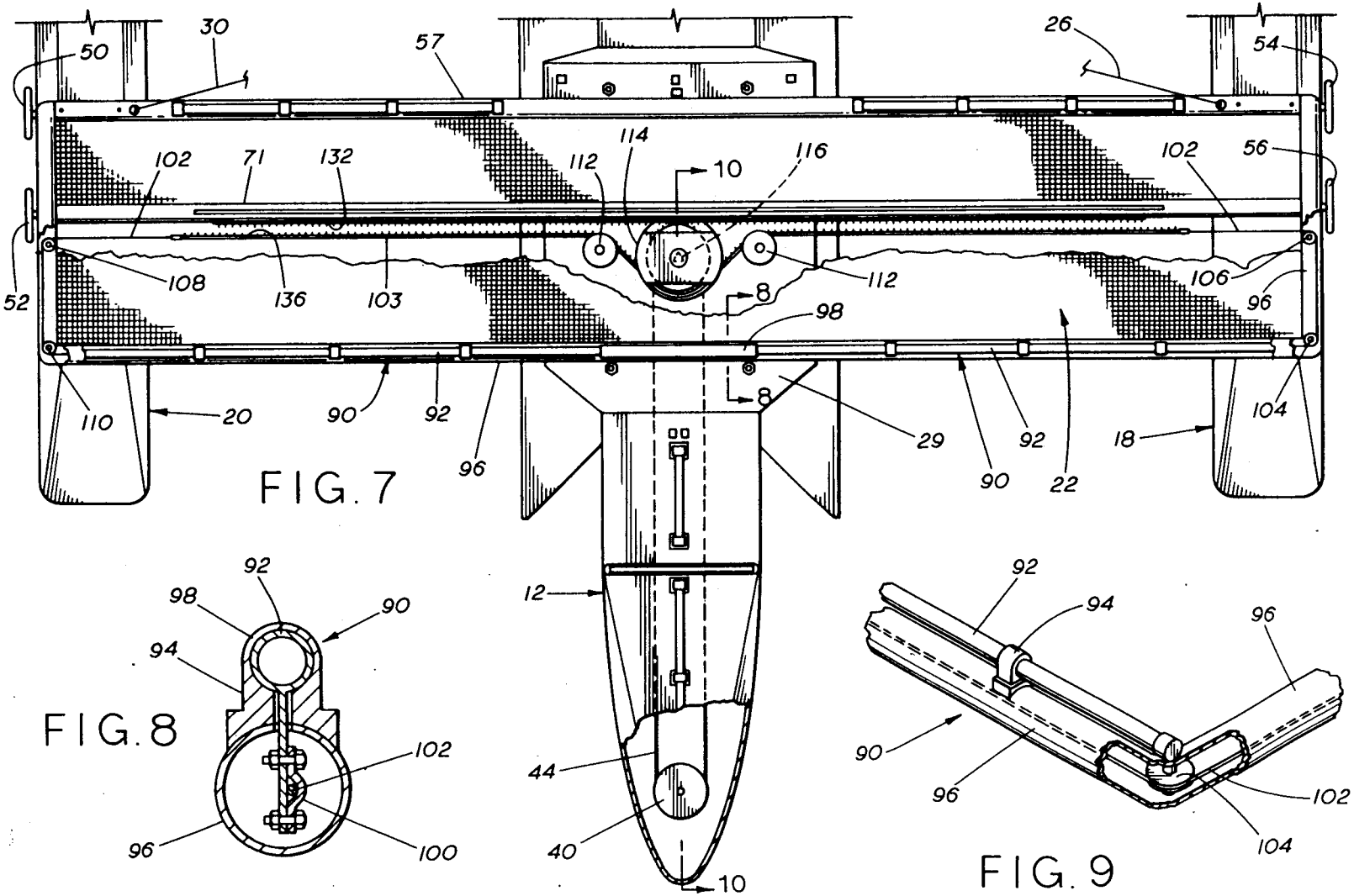
FIG. 7 is a top plan view, partly in cross-section, of a portion of the sailing craft in accordance with the present invention.
FIG. 8 is an elevated view, in cross-section, of the rudder control line in accordance with the present invention taken along the section lines 8—8 of FIG. 7.
FIG. 9 is a pictorial view, partly in cross-section, of a segment of the rudder control line in accordance with the present invention.
Figure 14:
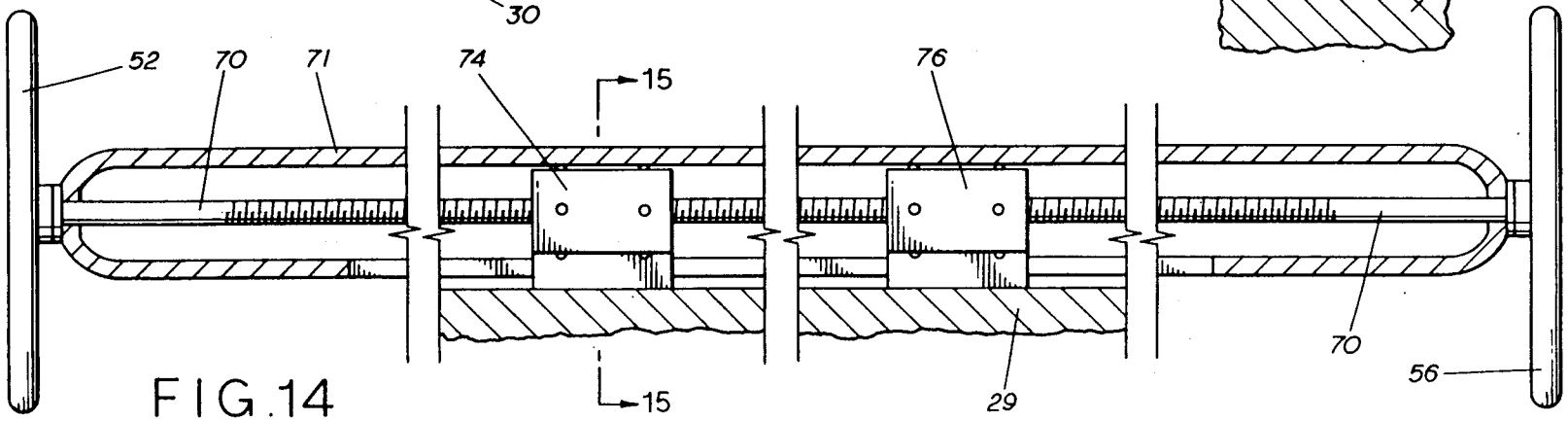
FIG. 14 is an elevated view, partly in cross-section, of the control mechanism used to control the wing position with respect to the central hull of the sailing craft in accordance with the present invention.

The rotary handles 52 and 56 illustrated in FIGS. 7 and 14 provide a means for moving the central hull 12 back and forth with respect to the outrigger hulls 18 and 20. In FIG. 14, it is seen that either of the rotary handles 52 and 56 drives a threaded shaft 70 which threadedly engages a box 74 and a box 76. The boxes 74 and 76 are fixedly attached to the to the wing platform 29 which is fixedly attached to the main control hull 12. The tube 71 is fixedly attached to the wing 22.

In the operation of the apparatus illustrated in FIG. 14, by rotating either the rotary handle 52 or the rotary handle 56, the wing 22 will move back and forth with respect to the main hull 12. Thus, by moving either of the rotary wheels 52 or 56, the main hull 12 moves back and forth between the outrigger hulls 18 and 20.

Figure 13:
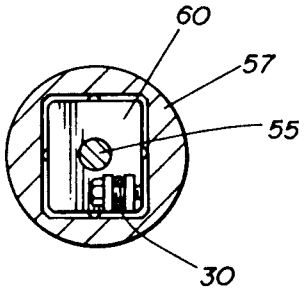
FIG. 13 is a cross-sectional view of the apparatus illustrated in FIG. 12, taken along the section lines 13—13.

FIG. 13 represents a cross-sectional view taken along the lines 13—13 of FIG. 12 in which the interior of the tube 57 is rectangular in shape to accommodate the movement of the box 60 with respect to the interior of the tube 57.

Figure 15:
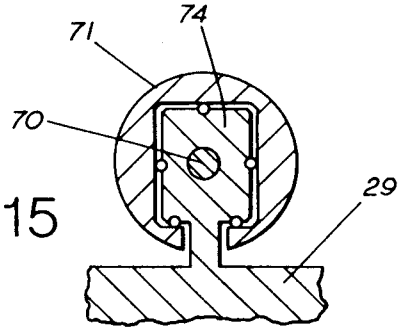
FIG. 15 is an elevated view, in cross-section, of the apparatus illustrated in FIG. 14, taken along the section line 15—15.

FIG. 15 is a cross-sectional view taken along sectional lines 15—15 of FIG. 14 which illustrates the tube 71 in which the rectangular box 74 is located. As the wheels 52 or 56 are turned, the tube 71, fixedly attached to the wing 22, passes over the box 74. As shown in FIG.'S 14 and 15, the box 74 and the box 76 are fixedly attached to the wing platform 29. Although not illustrated, those silled in the art will recognize and appreciate the fact that the boxes 74 and 76 can use ball bearings or the like, between the boxes 74 and 76 and tube 71, to facilitate the movement of the wing 22 through the wing platform 29.

Referring again to FIG.'S 7–9, on the trailing edge of the wing 22, a combination handrail and rudder control tube 90 runs for the entire length of the wing. The apparatus 90 includes a slidable tube 92 which passes through a plurality of standoff devices 94 which are each fixedly attached to a second tube 96 which is itself fixedly attached to the wing 22. The sliding tube 92 also passes through an elongated tunnel device 98 which is fixedly attached to the tube 96 as shown in cross-section in FIG. 8. Also attached to the sliding tubular member 92 is a keeper device 100 attached to the cable 102. The cable 102 also passes over pulleys 104, 106, 108 and 110. The pulleys 104 and 110 are located on the trailing edge at the respective ends of the wing 22, whereas the pulleys 106 and 108 are also located on the respective ends of the wing 22 but at opposite midpoints thereof. A belt 103, preferably a V-notched or toothed belt which is used to drive a part of the differential mechanism hereinafter described, is located between the ends of the cable 102 to complete a loop. Suffice it say at this point that a crewman located anywhere along the length of the wing 22 can grasp the sliding tube 92 and move it in either direction to control the rudder 16 as desired.

Referring now to FIG. 10 in greater detail, a belt 44 used to control the rudder 16 passes over an idler pulley 112 and another pulley 114 which in turn is driven by a shaft 116 having its lower end rotatably mounted in a bushing 118 which is fixedly mounted to a surface on the floor 120 of the central hull 12.

Figure 11:
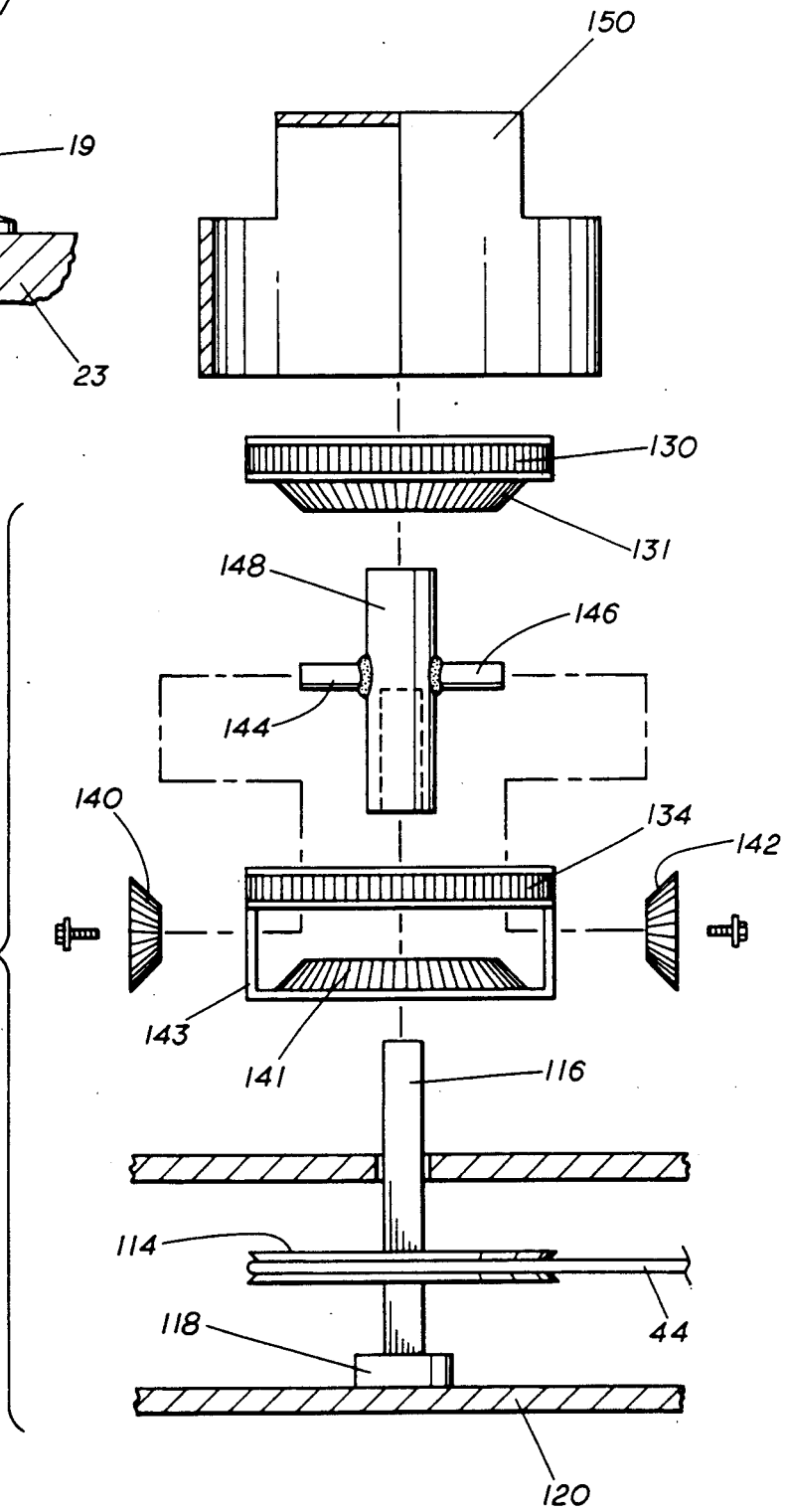
FIG. 11 is an exploded view, partly in cross-section, of the differential mechanism used to control the rudder on the sailing craft according to the present invention.
Figure 21:
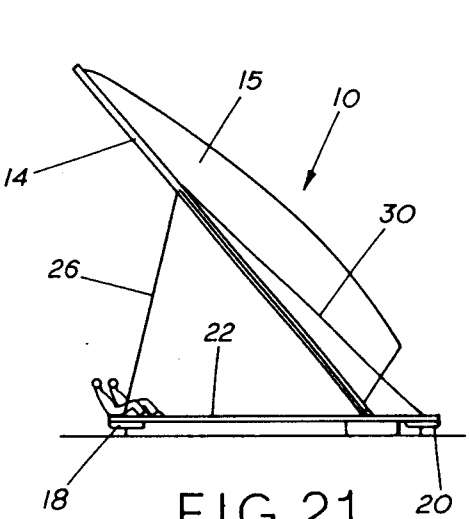
FIG. 21 is an end schematic view of the sailing craft illustrated in FIG. 19 but in which the mast has been further pivoted in the direction of the outrigger hull furtherest removed from the central hull.
Figure 22:
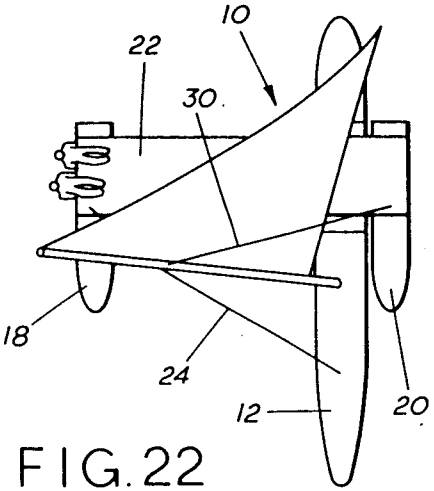
FIG. 22 is a top schematic view of the sailing craft having its movable parts in the same position as illustrated in FIG. 21: and FIG.'S 23 and 24 are schematic views of the sailing craft according to the present invention illustrating diassembly and the loading of the sailing craft onto a trailer for transport.

Referring now to FIG. 11, the differential mechanism used to control the rudder 16 is explained in greater detail. Tube 71, having teeth 132 as illustrated in FIG. 7, causes such teeth 132 to mesh with ring gear 130 which free wheels about the shaft 148 of FIG. 11. The V-notches or teeth 136 of belt 103 engage ring gear 134 which also free wheels about the shaft 148. Shaft 148 is keyed to shaft 116, causing such shafts 116 and 148 to turn as one. The bevel gear 131 engages bevel gears 140 and 142, which in turn engage bevel gear 141. The bevel gears 140 and 142 rotate on the axels 144 and 146, respectively, the axels 144 and 146 being transversely mounted on shaft 148. The frame assembly 143 causes the ring gear 134 and the bevel gear 141 to rotate together about the shaft 148. A protective cover 150 prevents, water, dirt and other contaminants from entering the differential mechanism illustrated in FIG. 11.

In the operation of the rudder, it should be appreciated that the control of the rudder is complicated by the fact that the wing, from which the rudder is controlled, is moved from time to time with respect to the central hull in which the rudder is located. With the apparatus described above, the movement of the wing effects both of the ring gears 130 and 134, in that upon movement of the wing, gear 130 will rotate in one direction, and gear 134 in the other direction, cancelling each other out. With such movement of the wing, shaft 148 does not rotate. Bevel gear 131 is an integral part of ring gear 130 and also freely turns about the exterior of shaft 148.

However, when the rudder control tube 92 (FIG. 9) is moved in one direction or the other, the teeth 136 of belt 103 cause the ring gear 134 to rotate, thus causing bevel gear 141 to rotate, which in turn cause bevel gears 140 and 142 to "walk around" bevel gear 131. Because they are located on axels 144 and 146, this causes shaft 148 to rotate and turn the rudder 16. As this operation is ongoing, bevel gear 131 is not itself rotating about the shaft 148, because of ring gear 130 being held in a stationary position by the teeth 132 on tube 71.

Thus, by using the differential apparatus of FIG. 11, the rudder can be controlled merely by manipulating the tube 92 illustrated in FIG. 9 regardless of the location of the wing 22 with respect to the central hull 12 within which the rudder is mounted.

Referring now to FIG.'S 17–22, the sailing craft 10 first illustrated in FIG.'S 17 and 18 will typically commence sailing with the mast 14 in the vertical postion and the center hull located in an intermediate position between the outrigger hulls 18 and 20. By manipulating either of the rotary handles 52 or 56, the center hull can be moved closer to the outboard hull 18 as illustrated in FIG.'S 19 and 20. In this position, the two crewman are illustrated as being located on the wing 22 immediately above the outboard hull 20. This position provides tremendous mechanical advantage for the crew to hold down the windward side of the boat. This added ability to hold the windward side down allows the use of a larger sail to provide increased driving power. As the wind becomes stronger, the mast 14 is leaned to the windward as illustrated in FIG.'S 19 and 20. As the wind becomes even stronger, the mast 14 can be leaned even further to the windward as illustrated in FIG.'S 21 and 22. This angulation of the sail reduces the driving and heeling forces but increases lifting forces thereby bringing about a reduction in the weight of the boat and therefore the depth of displacement and reduction in hull resistance. The planing of the main hull will also bring about a reduction of the depth of displacement.

Figure 19:
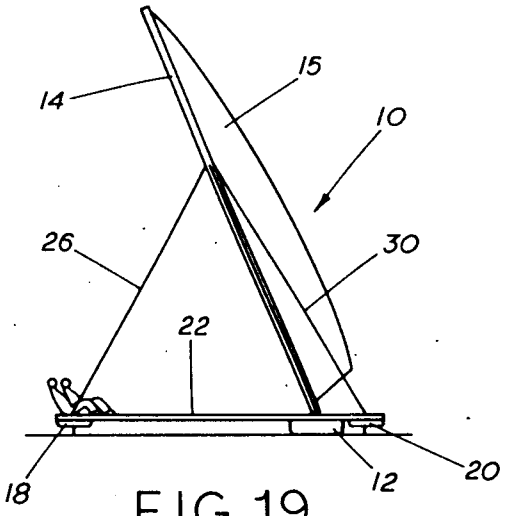
FIG. 19 is an end schematic view of the sailing craft in accordance with the present invention in which the central hull has been positioned near one of the outrigger hulls and the mast has been partially pivoted in the generaly direction of the other outrigger hull.
Figure 20:
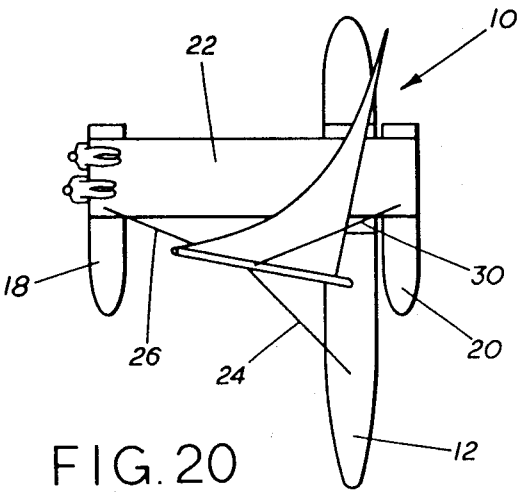
FIG. 20 is a top schematic view of the sailing craft having its movable parts in the same position as illustrated in FIG. 19.
Figure 17:
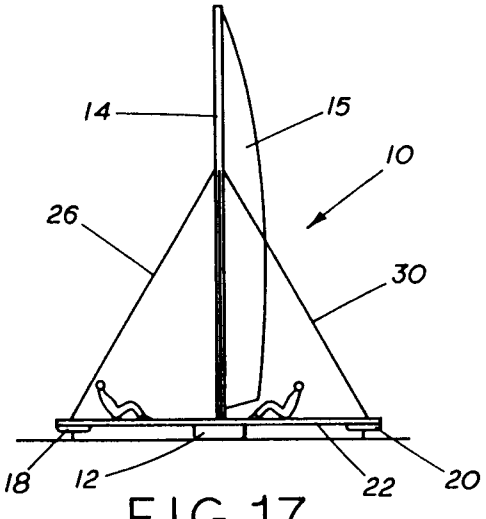
FIG. 17 is a schematic end view of the sailing craft in accordance with the present invention in which the central hull is positioned midway between the two outrigger hulls and having the mast in the vertical postion.
Figure 18:
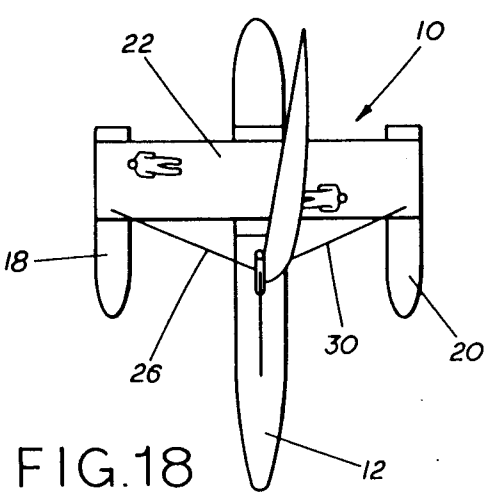
FIG. 18 is a top schematic view of the sailing craft having its movable parts in the same position as indicated in FIG. 17.

It should be appreciated that by having the lines 26 and 30 at the mid-point of mast 14, merely moving the main hull 12 towards one of the outrigger hulls cuases the mast 14 to lean toward the other outrigger hull and the lines to stay taut without further adjustment, unless desired, approximately as illustrated in FIG. 19. If further leaning of the mast is desired, the additional lean can be accomplished by rotating either of the rotary handles 50 and 54.

The ideal sailing configuration in light winds involves keeping the mast vertical to provide maximal sail area for driving power and in heavy winds to lean the sail to the windward to provide reduction of driving power while increasing lifting power. In all cases the most desirable condition is to have only the main hull 12 immersed in water and the crew balanced such that part of the hydrofoil on the windward side is also in the water.

Figure 23:
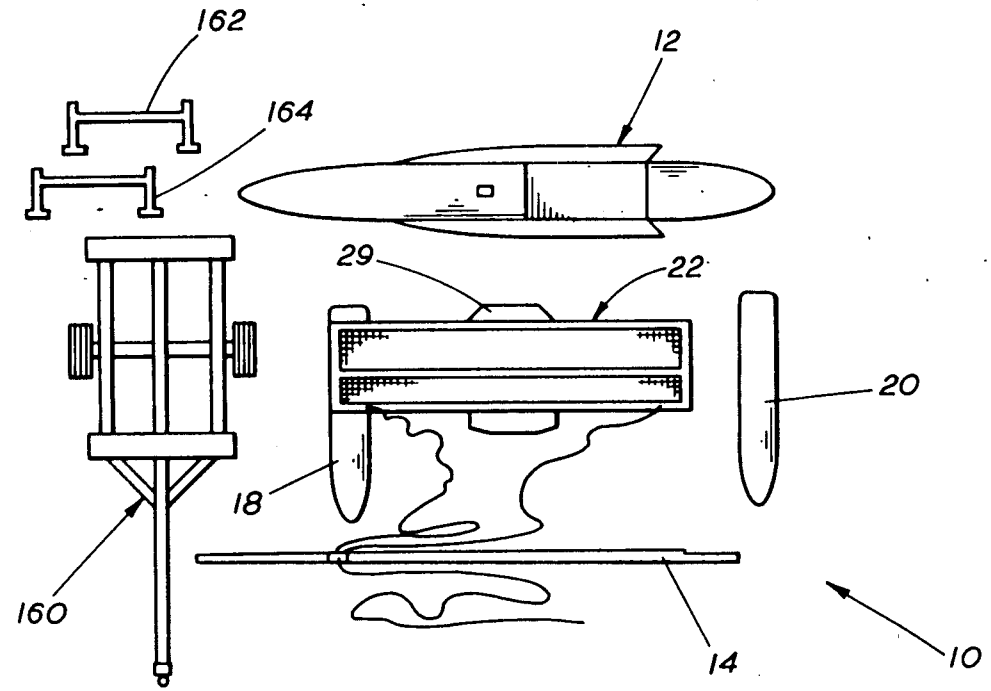

FIG. 23 illustrates the various components of the sailing craft in accordance with the present invention which have been disassembled for transport on the trailer 160. As illustrated, the main hull 12 is separated from the wing 22 and the outrigger hulls 18 and 20.

Figure 24:
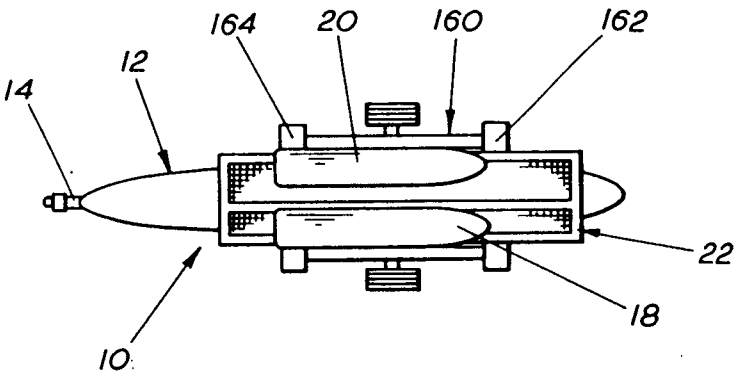

FIG. 24 shows the manner in which the main hull 12, the wing 22 and the outrigger hulls 18 and 20 are mounted in the mounting fixtures 162 and 164 on the trailer 160 for transportation over the highways.

Thus there has been described herein the preferred embodiments of the present invention, an invention which provides for a pivotable mast to be moved first towards a leeward outrigger hull and then leaned towards a windward outrigger hull. Although not illustrated herein, a less-preferred embodiment would utilize a pair of outrigger hulls joined by a wing but not necessarily having a central hull. A pivotable mast could be moved towards the leeward end of the wing, for example, on a track, and then with sail attached, leaned into the wind.

What is claimed is:

1. A sailing craft, comprising:

a wing having first and second ends;

first and second outrigger hulls mounted on said first and second ends of said wing, respectively;

a central hull located between said first and second outrigger hulls, said central hull being movably connected to said wing, whereby said central hull can be moved closer to either one of said first and second outrigger hulls; and a pivotable mast mounted on said central hull for leaning said mast towards either one of said outrigger hulls, thereby enabling the central hull to be moved towards one of said first and second outrigger hulls and the mast leaned towards the other of said first and second outrigger hulls.

2. The sailing craft according to claim 1, being characterized further by a control wheel located at one of the said first and second ends of said wing for moving said central hull back and forth between said first and second outrigger hulls.

3. The sailing craft according to claim 1, being characterized further by first and second control wheels located at said first and second ends of said wing, respectively, for moving said central hull back and forth between said first and second outrigger hulls.

4. A sailing craft, comprising:

a wing having first and second ends;

first and second outrigger hulls mounted on said first and second ends of said wing, respectively; and a central hull located between said first and second outrigger hulls, said central hull being movably connected to said wing, whereby said central hull can be moved closer to either one of said first and second outrigger hulls, said craft including first and second control wheels located at said first and second ends of said wing, respectively, for moving said central hull back and forth between said first and second outrigger hulls.

5. The sailing craft according to claim 4, including in addition thereto, a rudder located on the underside of said central hull and means running along substantially the entire length of said wing for controlling said rudder independently of the position of said central hull with respect to the first and second outrigger hulls.

6. A sailing craft, comprising:

a wing having first and second ends;

first and second outrigger hulls mounted on said first and second ends of said wing, respectively;

a central hull located between said first and second outrigger hulls, said central hull being movably connected to said wing, whereby said central hull can be moved closer to either one of said first and second outrigger hulls;

a pivotable mast mounted on said central hull for leaning said mast towards either one of said outrigger hulls, thereby enabling the central hull to be moved towards one of said first and second outrigger hulls and the mast leaned towards the other of said first and second outrigger hulls;

a rudder located on the underneath side of said central hull; and means running along the length of said wing for controlling said rudder independently of the position of said central hull with respect to the first and second outrigger hulls.

7. The sailing craft according to claim 6, including in addition thereto, a control wheel located at one of the said first and second ends of said wing for moving said central hull back and forth between said first and second outrigger hulls.

8. The sailing craft according to claim 6, being characterized further by first and second wheels located at said first and second ends of said wing, respectively, for moving said central hull back and forth between said first and second outrigger hulls.

9. A method for uitlizing a sailing craft having leeward and windward outrigger hulls joined by a wing and a central hull positionable along the length of said wing and having pivotable mast mounted on said central hull, comprising:

moving said central hull towards the leeward outrigger hull; and leaning said mast with a sail attached thereto towards the windward outrigger hull.

* * * * *